United States Patent [19]

Santopietro

[11] Patent Number: 4,750,892

[45] Date of Patent: Jun. 14, 1988

[54] ELECTRICAL DEVICE ADAPTER

[75] Inventor: Michael Santopietro, Staten Island, N.Y.

[73] Assignee: Eastrock Technology Inc., Edison, N.J.

[21] Appl. No.: 4,081

[22] Filed: Jan. 15, 1987

[51] Int. Cl.[4] ..... H01R 31/06

[52] U.S. Cl. ..... 439/307; 439/642

[58] Field of Search ..... 339/76, 79, 82, 83, 339/84, 85, 86, 87; 439/304–309, 641–649

[56] References Cited

U.S. PATENT DOCUMENTS

| | | | |
|---|---|---|---|
| 1,339,351 | 5/1920 | Kemble | 313/51 |
| 1,384,961 | 7/1921 | Klein | 339/84 |
| 1,506,183 | 8/1924 | Kellner | 339/85 |
| 1,506,184 | 8/1924 | Kellner | 339/85 |
| 1,675,353 | 7/1928 | Kellner | 339/85 |
| 1,676,323 | 7/1928 | Clemetson et al. | 313/51 |
| 1,738,683 | 12/1929 | Bashara et al. | 313/51 |
| 1,776,506 | 9/1930 | Houghton | 313/51 |
| 2,113,138 | 4/1938 | Healey | 339/85 |
| 2,115,500 | 4/1938 | Shearer | 176/31 |
| 2,129,379 | 9/1938 | Mollan | 176/31 |
| 4,093,333 | 6/1978 | Tjornhom, Sr. | 339/84 |
| 4,623,823 | 11/1986 | Engel | 315/58 |

*Primary Examiner*—John McQuade

*Attorney, Agent, or Firm*—Fitzpatrick, Cella, Harper & Scinto

[57] ABSTRACT

An adapter for connecting an electrical device such as a flourescent lamp to a threaded socket is provided with a device for inhibiting removal of the adapter from the socket to prevent theft of the adapter. The adapter may include a toroidal transformer, and a locking pin may be received within the space enclosed by the transformer.

16 Claims, 2 Drawing Sheets

ELECTRICAL DEVICE ADAPTER

BACKGROUND OF THE INVENTION

The present invention relates to electrical device adapters.

Adapters are utilized for connecting various electrical devices to sockets such as the common threaded socket utilized with ordinary incandescent light bulbs. One type of adapter is arranged to connect a fluorescent bulb to the socket in place of the incandescent bulb. The fluorescent bulb must be electrically connected to a transformer, also referred to as a "ballast", for proper operation. Therefore, adapters for fluorescent bulbs ordinarily incorporate the ballast and associated circuitry. These adapters typically have a housing and socket connection means at one end of the housing including a generally cylindrical male threaded collar and a central terminal similar to those found on an ordinaly light bulb. Lamp connection means are provided at the other end of the housing for engaging the fluorescent bulb. The ballast and associated circuitry is disposed within the housing. Therefore, a lamp socket as typically utilized for an incandescent bulb can be converted to receive a fluorescent bulb merely by screwing the adapter into the socket. Adapters of this nature have been available heretofore from Eastrock Technology, Inc. of Edison, N.J. These adapters have been widely utilized, particularly in institutional applications such as hotels, schools and the like. They allow the user to enjoy the increased lighting efficiency and energy savings afforded by fluorescent lighting without the expense of rewiring to install fluorescent fixtures in place of incandescent fixtures.

However, adapters of this type necessarily incorporate circuit elements, such as the transformer or ballast, which have appreciable value. Although the adapters are inexpensive enough that their cost is outweighed by the long-term savings in energy costs, the adapters are nontheless far more expensive than the ordinary light bulbs which they replace. Because these adapters fit any standard light bulb socket, they can be utilized in the home as well. Also, because the adapter typically is secured to the bulb socket only by threaded engagement with the bulb socket, the adapter can be removed just as easily as it can be installed. Theft of the adapters has become an appreciable problem. Such theft, and the possibility thereof, have deterred some users from employing adapters of this type. Similar problems have been encountered with other electrical device adapters, particularly those having relatively expensive circuit elements such as transformers.

SUMMARY OF THE INVENTION

The present invention provides solutions to these problems.

One aspect of the present invention provides an adapter for connecting an electrical device, preferably a fluorescent light bulb, to a socket such as a threaded socket. The device preferably includes a housing and socket connection means mounted to the housing for engaging the socket and making electrical connection therewith, preferably by threadedly engaging the threads of the socket. The adapter most preferably also includes means for engaging an electrical device such as a fluorescent lamp and making electrical connection therewith. Internal circuit means, most preferably including a transformer mounted within the housing, are provided for electrically interconnecting the socket connection means with the device or lamp-receiving means. Thus, where the adapter is installed in a socket, the electrical device such as a fluorescent light bulb can be engaged with the adapter and will receive the appropriate electrical power or signal through the adapter.

In an adapter according to this aspect of the invention, inhibit means most preferably are provided for selectively inhibiting or permitting disengagement of the socket-connecting means from the socket. The housing preferably substantially conceals the inhibit means so as to hinder operation of the inhibit means by unauthorized persons. Typically, the inhibit means is arranged so that in a normal state, in the absence of actuation, the inhibit means hinders disengagement of the adapter from the socket whereas and permits such disengagement only upon actuation. Therefore, it is extremely difficult for an unauthorized individual, unaware of procedures for actuating the inhibit means, to disengage the adapter from the socket. This arrangement substantially solves the problem of adapter theft.

A further aspect of the present invention incorporates the realization that the characteristics of certain transformers can be exploited in an adapter structure. Particularly in the case of an adapter for engaging a fluorescent lamp with a common threaded socket, the transformer must be present to provide the needed electrical characteristics. Ordinarily, the transformer is mounted within the housing, between the lamp engaging or "proximal" end and the socket engaging or "distal" end of the housing. To provide the desired electrical characteristics, the transformer typically must be curvilinear or loop-like. Thus, the transformer may be generally in the form of a figure-8 or, more typically, may be generally toroidal. According to this aspect of the present invention, the curvilinear transformer is arranged within the housing so that it defines a passageway extending generally proximally and distally. For example, a toroidal transformer can be arranged so that the axis of the toroid extends generally proximally and distally. The inhibit means are arranged to permit or inhibit disconnection of the socket-connecting means from the socket responsive to positioning of an object in the passageway. Thus, the inhibit means can be controlled from the proximal end of the housing. States another way, this aspect of the present invention utilizes at least part of the space encompassed by the curvilinear transformer to provide a route through the adapter, from the proximal end to the distal end, for actuation of the inhibit means. The inhibit means may include a pin or rod extending generally proximally and distally through the passageway defined by the transformer, and the inhibit means may be arranged to inhibit or permit disconnection of the socket-connecting means in response to movement of this pin or rod.

According to a further, preferred aspect of the present invention, the socket connection means includes a generally cylindrical threaded shell adapted to engage a threaded socket as for example, a typical threaded incandescent bulb socket. The cylindrical shell preferably is mounted to the distal end of the housing so that the axis of the shell extends generally proximally and distally, and so that the shell is free to rotate with respect to the housing about the shell axis. The shell may be provided with a catch, such as a hole, notch or the like remote from the shell axis and the housing may be provided with a bore opening to the exterior of the housing and confronting the shell so that the catch moves into and out of alignment with the open end of the bore upon rotation of the shell relative to the housing. For example, where the catch on the shell is disposed at a predetermined distance from the shell axis, the open end of the bore may be disposed at the same distance from the shell axis. Preferably, a pin is disposed in the bore and this pin can be moved either to an extended position in which the pin protrudes from the bore to engage the catch or a retracted position in which the pin does not engage the catch. When the pin is in the extended position, rotation of the shell relative to the housing is arrested, so that the shell can be engaged or disengaged from a threaded socket simply by rotating the housing about the shell axis. Conversely, when the pin is in the retracted position, the shell is free to rotate relative to the housing and hence rotation of the housing will not disengage the shell from the threaded pocket. Desirably, bias means are provided for biasing the pin towards its retracted position. The bore in the housing preferably is aligned with the passageway defined by the transformer, and the pin most preferably extends directly through the bore and the passageway, substantially between the distal and proximal ends of the housing. The housing most preferably is provided with an aperture in a proximal end wall, and the pin extends to but not out of this aperture so that the pin remains effectively concealed within the housing. An authorized individual, knowing the mode of operation of the device, can readily engage the proximal end of the pin with a tool inserted through the aperture, and thus move the pin to the extended position and remove the adapter from a socket. However, an unauthorized person who does not know how the adapter works ordinarily will not be able to find the pin and will not know how to actuate it. According to further preferred aspects of the present invention, the aperture at the proximal end of the housing is integrated with the features which engage the lamp, as more fully explained hereinbelow, so that the aperture is effectively concealed while the lamp is present and is at least partially concealed even where the lamp is removed from the adapter.

As pointed out above, the inhibit means in particularly preferred adapters according to the present invention can be controlled from the proximal end of the adapter. As the proximal end typically protrudes from the socket, the inhibit means can be actuated to permit removal of the device even where the socket is recessed or otherwise disposed within close confines as in a relatively small lamp fixture. The present invention therefore provides adapters which are particularly convenient to use. Moreover, the additional features provided by the present invention typically add almost nothing to the cost of the adapter and add nothing whatsoever to the bulk of the adapter.

These and other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENTS

Figure 1:
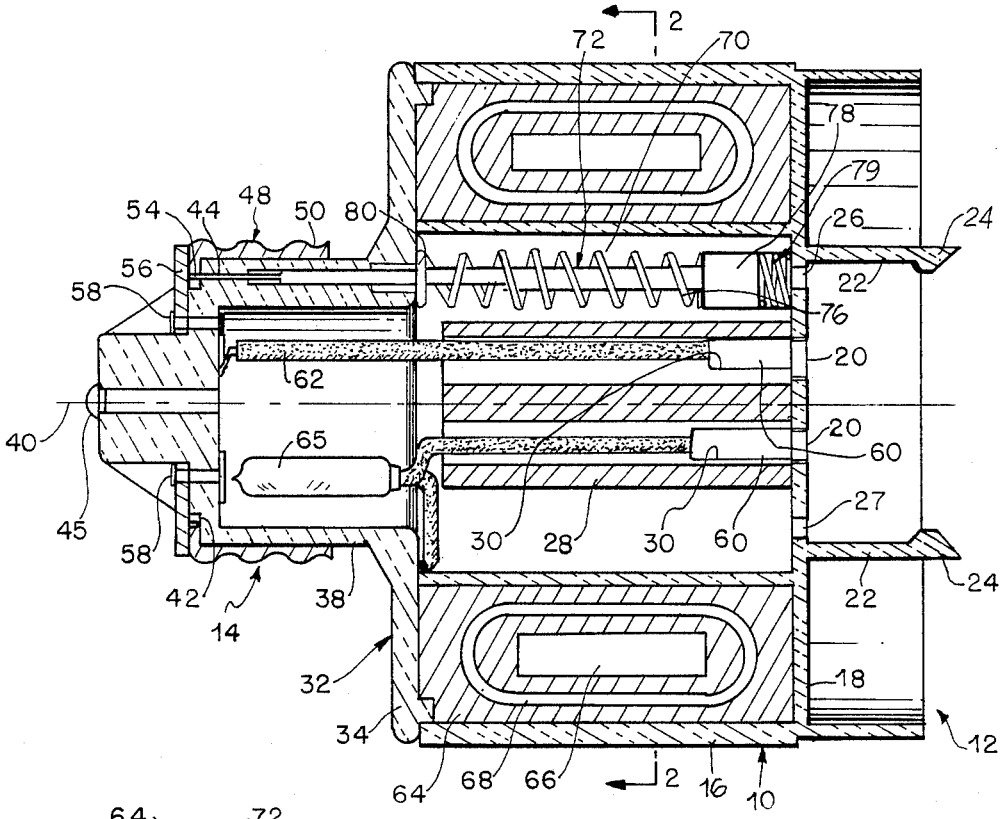
FIG. 1 is a schematic sectional view of an adapter according to one embodiment of the present invention.
Figure 2:
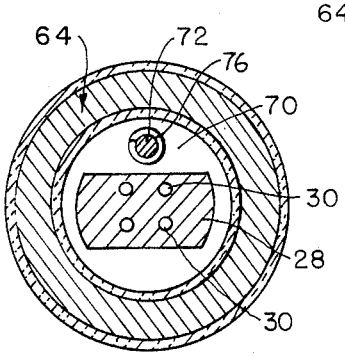
FIG. 2 is a schematic sectional view on line 2—2 in FIG. 1.

An adapter according to one embodiment of the present invention includes a housing 10 having a proximal end 12 and a distal end 14. Housing 10 includes a generally cylindrical proximal end portion 16 having a proximal end wall 18, connector holes 20 in the proximal end wall and a pair of prongs 22 projecting in the proximal direction from proximal end wall 18. Each of prongs 22 has a projection 24 at its proximal end, remote from proximal end wall 18, the projections 24 on the prongs extending inwardly towards one another. The proximal end wall 18 also has an aperture 26 aligned with one of projections 24 and a further aperture 27 aligned with the other projection 24. Thus, each projection 24 overlies one of the apertures 26 or 27. A connector block 28 is also formed integrally with proximal end wall 18, so that the connector block protrudes generally distally from this wall. Connector block 18 has a plurality of contact bores 30 extending proximally and distally, in alignment with connector holes 20.

Housing 10 also has a distal end portion 32 defining a distal end wall 34 and a generally cylindrical boss 38 projecting distally from distal end wall 34. The axis 40 of boss 38 is substantially coincident with the proximal to distal axis of cylindrical, proximal end component 16. Boss 38 has a shoulder 42 extending generally transverse to the axis 40 adjacent the distal end of the boss. Housing components 32 and 16 are permanently fixed to one another. Distal end component 34 has a bore 44 extending substantially proximally and distally at a predetermined distance from axis 40 so that the distal end 46 of bore 44 opens through shoulder 42.

Socket connection means are provided at the distal end of housing 10. The socket connection means include a central pin 45 extending through the distal extremity of boss 38 and a generally cylindrical shell 48 surrounding boss 38, the axis of shell 48 being coincident with the axis 40 of the boss and housing. Shell 48 has threads 50 extending helically around axis 40 and a flange 52 projecting inwardly, towards axis 40 at the distal end of collar 48. Flange 52 overlies and confronts shoulder 42 on boss 38. Flange 52 is provided with a plurality of small holes 54 extending proximally and distally through the flange, holes 54 being disposed at a predetermined distance from axis 40 equal to the predetermined distance between axis 40 and bore 44. Shell 48 is retained on boss 38 by a washer 56 overlying flange 52, the washer being held to the boss by a pair of rivets 58. The washer 56 bears on flange 52 and makes electrical contact therewith but does not prevent the shell from rotating relative to the boss. Thus, shell 48 is free to rotate with respect to the housing about the axis 40 of boss 38. As will be appreciated, rotation of shell 48 about axis 40 will bring each hole 54 successively into and out of alignment with the distal end 46 of bore 44.

Shell 48 and center pin 45 are dimensioned to fit within a standard threaded electric socket of the type normally utilized for incandescent bulbs in the common sizes used for domestic lighting. Thus, threads 50 are of the requisite pitch, form and diameter to mesh with the threads of such a socket, and center pin 45 is adapted to engage the center terminal of the socket.

Figure 4:
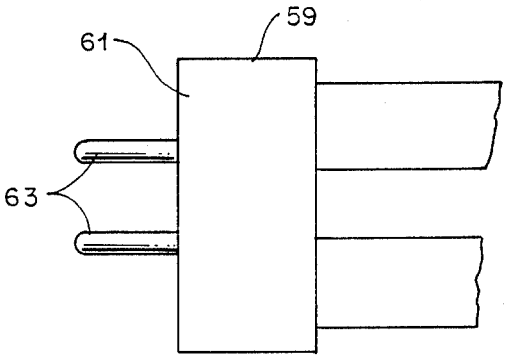
FIG. 4 is a fragmentary elevational view of a lamp used with the adapter of FIG. 1.

A plurality of hollow resilient lamp terminals 60 are disposed in the bores 30 of terminal block 28, so that the lamp terminals are aligned with connector holes 20 in the proximal wall. The lamp terminals, together with connector holes 20, prongs 22 and projections 24 define lamp receiving means adapted to physically engage a so-called "compact" fluorescent light bulb and to make electrical connection therewith. A compact bulb 59, as illustrated in FIG. 4, typically has a base 61 and connector pins 63. When the lamp is received in the lamp receiving means, connector pins 63 pass through connector holes 20 and engage terminals 30 in electrical contact therewith, whereas base 61 is received between prongs 22 and releasably secured by projections 24. As the base 61 of the lamp is engaged between the prongs, the prongs bend outwardly, away from one another, and then bend back to their original position.

Appropriate circuit means are provided within housing 10 for electrically interconnecting lamp terminals 60 with the socket connection means, so that when the socket connection means is engaged with an energized electrical socket, appropriate power will be provided to lamp terminals 60. The electrical circuitry of the interconnection means per se is conventional, and resembles that found in a conventional fluorescent fixture. Thus, a ballast transformer 64 and glow lamp 65 are interconnected with one another, with lamp terminal 60 and with the socket connection means according to a conventional electrical schematic which need not be described herein. In this case, however, transformer 64 is toroidal. It includes a toroidal metallic core 66 and windings 68 mounted on the core and following the toroidal curvature of the core. Transformer 64 is mounted to the proximal portion 16 of housing 10 so that the axis of the toroidal transformer is coincident with the axis 40 of the boss and the remainder of the housing. Toroidal transformer 64 thus defines a cylindrical passageway 70 extending generally proximally and distally through the housing. Bore 44 in boss 38 at the distal end of the housing communicates with one of the aperatures 26 in proximal end wall 18 via passageway 70, both the aperture 26 and the bore 44 being aligned with a portion of passageway 70 adjacent the periphery of passageway 70.

Figure 3:
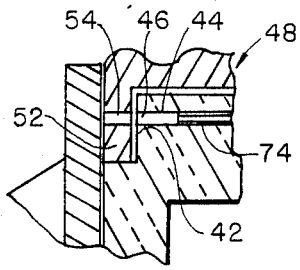
FIG. 3 is a schematic, fragmentary sectional view on an enlarged scale depicting a portion of the apparatus shown in FIG. 1.

An elongated pin 72 extends through passageway 70 and into bore 44, the distal end 74 of the pin being positioned within bore 44, (FIG. 3). Pin 70 is slidable generally proximally and distally with respect to housing 16 between the retracted position illustrated and an extended position. As best appreciated with reference to FIG. 3, in the retracted position the distal end 74 of the pin does not protrude through the distal end 46 of bore 44. However, in the extended position, wherein the pin is moved distally from the position shown, the distal end 74 of the pin 72 protrudes from the distal end of bore 46 and hence protrudes distally beyond shoulder 42. In the extended position, the distal end of the pin will engage in one of the holes 54 in the flange of shell 48. A coil spring 76 surrounding pin 72 bears on an enlarged head 78 at the proximal end of the pin and biases the entire pin in the proximal direction, towards the retracted position illustrated. The distal end 80 of spring 76 bears on the proximal surface of distal end wall 34. A further, very stiff coil spring 79 is interposed between head 78 and the proximal end wall 18 of housing 10 at aperture 26.

As will be appreciated, with the pin in the retracted position illustrated, the device cannot be either engaged with or disengaged from a threaded lamp socket. Any attempt to insert the device in a socket or remove it from a socket by rotating the housing 10 about axis 40 will be futile, because shell 48 will merely rotate with respect to the housing. Accordingly, threads 50 will not advance with respect to the threads of the threaded socket. Where the device is mounted in an threaded socket, it is substantially secure against theft.

Figure 5:
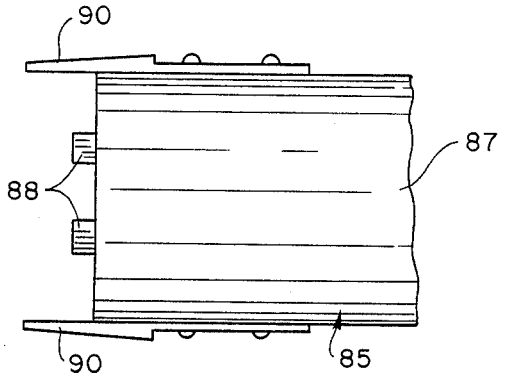
FIG. 5 is a fragmentary elevational view of a tool used with the adapter of FIG. 1.

However, an authorized person can readily engage the adapter with a threaded socket or disengage it from a threaded socket merely by removing the lamp 59 and inserting in place of the lamp a tool 85 as shown in FIG. 5. The tool has a body 87 with projections 88 adapted to engage the connector holes 20 in the proximal wall and has projections 90 adapted to enter apertures 26 and 27 when the tool body is engaged with the proximal end of the adapter in the space normally occupied by the lamp. Projections 90 are provided with sloped surfaces for forcing prongs 22 generally outwardly, away from one another. When tool 85 is engaged with the proximal end of the adapter, one of the projections 90 bears on the proximal end 91 of stiff spring 79, forcing that end towards the distal end of housing 10. Because spring 79 is stiffer than spring 76, pin 72 will also tend to move distally, towards its extended position. If one of the holes 54 in shell 48 is aligned with bore 44 and hence with the distal end 74 of pin 72 (FIG. 3), the distal end of the pin will engage the hole 54. This will arrest rotation of shell 48 with respect to housing 10. If none of the holes 54 in shell 48 is aligned with bore 44, pin 72 cannot move all the way to is extended position when tool 85 is inserted. In this case, stiff spring 79 will be compressed by projection 90 on the tool. Spring 79 will remain compressed until housing 10 is rotated to bring bore 44 into alignment with one of the holes 54, whereupon pin 72 will move to its extended position. Thus, stiff spring 79 serves as a buffer; it prevents damage to pin 72 upon insertion of tool 85. When the rotation of the shell is so arrested, the entire device can be inserted into a socket, and removed therefrom, simply by rotating the housing in the same way as the housing of an ordinary light bulb is turned to install or remove it. Thus, it is simple for an authorized person who has tool 85 in his possession and who knows how the device works to install or remove the adapter. This simplicity of installation is preserved even if the socket in which the adapter is installed is recessed or otherwise encumbered. As will be appreciated with reference to FIG. 1, the pin is actuated from the proximal end of the device and hence will not be obstructed even if the socket holding the distal end is recessed in a lamp fixture or otherwise relatively inaccessible.

Although it is simple for an authorized person to install or remove the adapter, an unauthorized person will have considerable difficulty. The pin 72 which is employed in arresting motion of the shell relative to the housing and hence in permitting removal of the adapter from the housing is effectively concealed within the housing 10. This concealment is aided by the lamp 59.

Even where the lamp is removed, however, the pin is still effectively concealed within the housing, inasmuch as it is disposed distally of proximal end wall 18. Although the pin might be detected by close inspection of aperture 26, such close inspection is effectively precluded by prong 22 and by projection 24. Moreover, the concealment of the pin within the housing is aided by the presence of connector holes 20 and the other aperture 27, all of which divert attention from aperture 26. Thus, although a skillful professional thief doubtless could defeat the security system incorporated in the adapter and steal the adapter, the casual pilferer will be effectively deterred.

Figure 6:
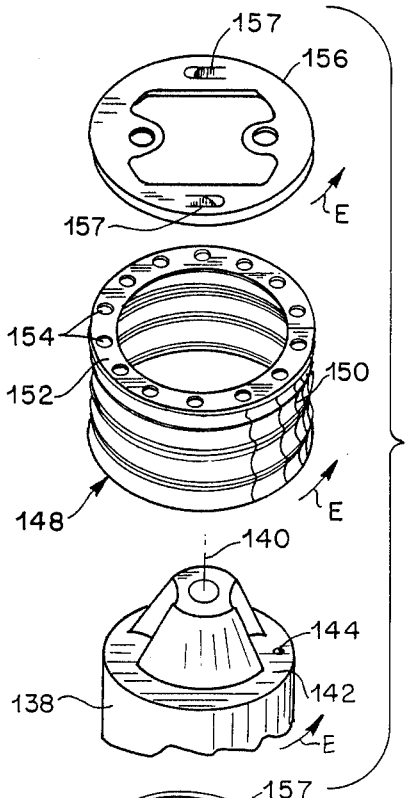
FIG. 6 is a fragmentary exploded view depicting a portion of an adapter according to a further embodiment of the present invention.
Figure 7:
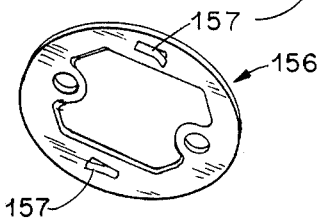
FIG. 7 is a schematic perspective view depicting an element of the adapter shown in FIG. 6.

Portions of a device according to a further embodiment of the present invention are illustrated in FIGS. 6 and 7. As shown in FIG. 6, this device includes a boss 138 having a shoulder 142 and bore 144 similar to the corresponding elements of the device discussed above with reference to FIGS. 1–5. A shell 148 identical to the shell 48 used in the adapter of FIGS. 1–5 is mounted on boss 138 so that shell 148 is concentric with the axis 140 of boss 138. Just as in the adapter discussed above with reference to FIGS. 1–5, the holes 154 in the flange of shell 148 will move into and out of alignment with the distal end of bore 144. The internal components of the adapter are the same as discussed above, and include a pin (not shown) which can be moved through bore 144 to engage any one of holes 154. However, in this embodiment, the washer 156 which holds the shell to the boss is provided with a pair of resilient pawls 157 projecting from the proximal face of the washer and bearing against the flange 152 of the shell. Pawls 157 extend generally tangentially with respect to axis 140 when the washer is mounted in its normal position, fixed to boss 138. Pawls 157 are arranged so that when the housing, and hence washer 156 are rotated about axis 140 in the direction indicated by the arrows E in FIG. 6, the tips of the pawls will engage the holes 154 in the shell flange. Thus, pawls 157 provide a "one-way clutch" or unidirectional drive means for driving shell 150 in rotation about axis 140 upon rotation about axis 140 upon rotation of the housing. This unidirectional drive means, however, is only operable to drive the shell in the threading direction, as indicated by arrows E, corresponding to engagement of the threads 150 with the threads of a socket, i.e., in clockwise rotation as viewed from the proximal end of the device. Although the pin must be actuated by a tool as described above to remove the device from the socket, the adapter can be installed in a threaded socket even without actuating the pin and the device can be installed even by a person who does not possess the tool. This is both a convenience and an added security feature. There is no need to tell workers who install the adapters anything about how to remove them, or to provide those workers with a tool for actuating the pin.

Numerous variations and combinations of the features described above can be employed. Thus, in both embodiments described above, removal of the adapter from the socket is inhibited by permitting the threaded collar to rotate with respect to the housing. However, in an alternative arrangement the threaded collar can be fixed to the housing and removal can be inhibited by a latch or gripper arranged to forecably engage the socket. The latch would be disposed at the distal end and would be release by the rod or pin 72 (FIG. 1) passing through the passageway in the transformer. This arrangement, however, is markedly less preferred inasmuch as it can be defeated by forecably twisting the housing so as to overpower the latch. Also, in the embodiments described above with reference to FIGS. 1–7, the pin 72 and spring 76 can be omitted. In such an arrangement, a very long, narrow pin would be inserted through aperture 26, transformer passageway 70 and bore 44 to arrest rotation of shell 48 with respect to the housing. This arrangement also is less preferred, inasmuch as it is less convenient for an authorized person to operate. Moreover, although adapters according to the present invention are particularly and uniquely suited to operation with fluorescent lamps, the invention can be applied to adapters for other purposes as well. Merely by way of example, an adapter according to the present invention can be made as a theft resistant adapter for adapting a low-voltage, battery powered appliance to operate from the power supplied through a lamp socket. In this case, the transformer would be employed as a step down transformer and, typically, appropriate rectifying means would be disposed within the housing as well. Also, although the toroidal transformer described above is particularly well suited to construction of adapters according to the invention, other forms of transformers can be employed. Thus, transformers having generally E-shaped, D-shaped, and U-shaped cores and windings are well-known and can be employed. All of these transformers define a substantially hollow internal space or passageway, and this passageway can be employed to provide space for transmission of actuating motion from the proximal or device receiving end of the housing to the socket engaging elements at the distal end of the housing.

As these and other variations and combinations of the features described above can be employed, the foregoing description of the preferred embodiments should be taken by way of illustration rather than by way of limitation of the present invention as defined in the claims.

What is claimed is:

1. A theft-resistant adapter for connecting an electrical device to a socket comprising:

(a) a housing having a proximal end and a distal end;

(b) socket connection means for connecting said distal end of said housing to the socket and establishing electrical contact with the socket;

(c) device receiving means for engaging an electrical device with said proximal end of said housing, and for making electrical connection with said electrical device;

(d) internal circuit means for electrically interconnecting said socket connecting means with said device receiving means, said internal circuit means including a transformer disposed within said housing between said proximal and distal ends, said transformer defining a passageway extending within said housing; and (e) inhibit means for selectively permitting or inhibiting disconnection of said socket connecting means from said socket responsive to movement of an object in said passageway, whereby said inhibit means can be actuated from said proximal end of said housing.

2. An adapter as claimed in claim 1 wherein said socket connection means includes a generally cylindrical threaded shell adapted to engage a threaded lamp socket, said threads of said shell defining a shell axis, said shell being mounted to said housing adjacent said distal end thereof for rotation relative to said housing about said thread axis, said inhibit means including arrest means for selectively arresting rotation of said shell relative to said housing to thereby permit disconnection of said shell from the socket by manual rotation of said housing relative to the socket, said arrest means normally permitting said rotation of said shell to thereby inhibit said disconnection.

3. An adapter as claimed in claim 2 wherein said shell has at least one catch remote from said shell axis, said housing has a bore communicating with said passageway, said bore having an end confronting said shell so that said catch on said shell moves into and out of registration with said end of said bore upon rotation of said shell relative to said housing, said arrest means including said bore and said catch.

4. An adapter as claimed in claim 3 wherein said shell axis, said bore and said passageway defined by said transformer extend generally proximally and distally, said bore being aligned with said passageway, the distal end of said bore confronting said shell.

5. An adapter as claimed in claim 4 wherein said arrest means includes a pin extending through bore and said passageway, said pin being movable with respect to said housing between a retracted position in which said pin does not protrude from said distal end of said bore and an extended position in which said pin protrudes from said distal end to engage said catch.

6. An adapter as claimed in claim 5 further comprising bias means for biasing said pin in said proximal direction, towards said retracted position.

7. An adapter as claimed in claim 5 wherein said pin has a distal end adjacent to the distal end of said bore and a proximal end adjacent the proximal end of said housing, said housing having a proximal end wall overlying said proximal end of said pin and an aperture aligned with said pin so that said pin can be engaged for movement to said extended position by a tool inserted through said aperture.

8. An adapter as claimed in claim 7 wherein said device receiving means includes a prong projecting out of said housing from said proximal end wall, said prong having a projection remote from said proximal end wall adapted to engage the device, said projection overlying at least a portion of said aperture whereby said projection also serves to impede access to said pin.

9. An adapter as claimed in claim 7 wherein said device receiving means is operative to secure a fluorescent lamp to said proximal end of said housing.

10. An adapter as claimed in claim 4 wherein said shell has a flange projecting transverse to said shell axis and said catch includes an opening in said flange.

11. An adapter as claimed in claim 10 wherein said housing has a boss projecting distally from the remainder of said housing at said distal end thereof, said boss having an axis, a distal end remote from the remainder of said housing and a shoulder extending generally transverse to said axis of said boss, said shell surrounding said boss and being mounted thereon so that said shell axis is aligned with the axis of said boss, said flange on said shell projecting inwardly towards said shell axis and overlying said shoulder on said boss, said distal end of said bore opening through said shoulder on said flange.

12. An adapter as claimed in claim 11 further comprising a washer fastened to said boss and disposed distally of said flange, whereby said washer retains said shell on said boss.

13. An adapter as claimed in claim 12 wherein said washer is restrained against rotation relative to said boss, said washer having a resilient pawl sloping towards said shoulder remote from said shell axis, said pawl being adapted to engage said opening in said flange upon rotation of said housing in the direction corresponding to engagement of said threads with the threads of the threaded socket, whereby said shell can be engaged in a threaded socket independently of operation of said arresting means, said pawl being adapted to disengage from said opening upon rotation of the housing about the axis of said boss in the direction corresponding to disengagement of said threads on said shell from the threaded socket.

14. An adapter as claimed in claim 2 further comprising unidirectional drive means for linking said shell to said housing for rotation therewith upon rotation of said housing about said shell axis in the direction corresponding to engagement of said threads with a threaded socket, said unidirectional drive means permitting rotation of said shell relative to said housing upon rotation of said housing in the direction corresponding to disengagement of said threads from a threaded socket, whereby said adapter can be engaged with a threaded socket independently of operation of said arrest means.

15. A theft-resistant adapter for connecting an electrical device to a threaded socket comprising:

(a) a housing having proximal and distal ends, said housing having a bore extending generally proximally and distally, the distal end of said bore being open to the exterior of said housing, said housing having an aperture open to the exterior of the housing adjacent the proximal end of the housing, said bore communicating with said aperture;

(b) socket connection means for connecting said housing to a threaded socket and making electrical contact with the socket, said socket connection means including a generally cylindrical threaded shell defining a shell axis, said shell being mounted to said housing so that said shell axis extends generally proximally and distally and so that said shell is rotatable with respect to said housing about said shell axis, said shell having a catch disposed remote from said shell axis so that said catch moves into and out of registration with said distal end of said bore upon rotation of said shell relative to said housing, whereby an object may be positioned in said bore to engage said catch and arrest rotation of said shell relative to said housing and permit disengagement of said shell from the socket upon rotation of said housing about said shell axis;

(c) device connection means for engaging an electrical device and making electrical contact with said device; and (d) internal circuit means within said housing for electrically interconnecting said socket connection means and said device connection means.

16. An adapter as claimed in claim 15 further comprising a pin disposed within said bore and movable between and extended position in which said pin protrudes distally from the distal end of said bore to engage said catch and a retracted position in which said pin does not protrude from said distal end of said bore, said pin having a proximal end aligned with said aperture, the adapter further comprising bias means for biasing said pin towards said retracted position, whereby said pin can be forced towards said extended position by a tool inserted into said housing through said aperture, at least the proximal end of said pin being substantially concealed within said housing.

* * * * *

UNITED STATES PATENT AND TRADEMARK OFFICE

CERTIFICATE OF CORRECTION

PATENT NO. : 4,750,892

DATED : June 14, 1988

INVENTOR(S) : MICHAEL SANTOPIETRO

It is certified that error appears in the above-identified patent and that said Letters Patent is hereby corrected as shown below: Title page:

AT [57] IN THE ABSTRACT

Line 2, "flourescent" should read --fluorescent--.

COLUMN 1

Line 20, "dinaly" should read --dinary--.
Line 40, "nontheless" should read --nonetheless--.

COLUMN 2

Line 16, "whereas" should be deleted.
Line 45, "States" should read --Stated--.

COLUMN 4

Line 32, "Connector block 18" should read --Connector block 28--.

COLUMN 5

Line 56, "bore 44," should read --bore 44--.

COLUMN 6

Line 16, "an" should read --a--.
Line 40, "is" (first occurrence) should read --its--.

UNITED STATES PATENT AND TRADEMARK OFFICE

CERTIFICATE OF CORRECTION

PATENT NO. : 4,750,892

DATED : June 14, 1988

INVENTOR(S) : MICHAEL SANTOPIETRO

It is certified that error appears in the above-identified patent and that said Letters Patent is hereby corrected as shown below:

COLUMN 7

Line 1, "where" should read --when--.
Line 40, "shell 150" should read --shell 148--.
Line 64, "forecably" should read --forcibly--.
Line 66, "release" should read --released--.

COLUMN 8

Line 1, "forecably" should read --forcibly--.
Line 15, "theft resistant" should read --theft-resistant--.
Line 19, "step down" should read --step-down--.

COLUMN 9

Line 20, "bore" should read --said bore--.

UNITED STATES PATENT AND TRADEMARK OFFICE

CERTIFICATE OF CORRECTION

PATENT NO. : 4,750,892

DATED : June 14, 1988

INVENTOR(S) : MICHAEL SANTOPIETRO

It is certified that error appears in the above-identified patent and that said Letters Patent is hereby corrected as shown below:

COLUMN 10

Line 57, "and" should read --an--.

Signed and Sealed this

Twenty-fourth Day of January, 1989

*Attest:*

DONALD J. QUIGG

*Attesting Officer*

*Commissioner of Patents and Trademarks*